US007934400B2

(12) United States Patent
Yoo et al.

(10) Patent No.: US 7,934,400 B2
(45) Date of Patent: May 3, 2011

(54) LAUNDRY TREATING APPARATUS

(75) Inventors: Sang Hee Yoo, Changwon-si (KR); Jong Deuk Bae, Changwon-si (KR); Kil Su Kim, Changwon-si (KR); Ji Maeng Kim, Changwon-si (KR); Young Bae Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 145 days.

(21) Appl. No.: 12/402,931

(22) Filed: Mar. 12, 2009

(65) Prior Publication Data

US 2009/0229314 A1 Sep. 17, 2009

(30) Foreign Application Priority Data

Mar. 13, 2008 (KR) ..... 10-2008-0023571

(51) Int. Cl.
*D06F 39/14* (2006.01)

(52) U.S. Cl. ..... 68/3 R; 68/196

(58) Field of Classification Search ..... 68/3 R, 68/196; 134/200

See application file for complete search history.

(56) References Cited

U.S. PATENT DOCUMENTS

| | | | | |
|---|---|---|---|---|
| 3,058,279 | A * | 10/1962 | Metcalfe | 55/495 |
| 6,361,433 | B1 * | 3/2002 | Gray | 454/358 |
| 7,013,683 | B1 * | 3/2006 | Walsh et al. | 68/134 |

FOREIGN PATENT DOCUMENTS

| | | | |
|---|---|---|---|
| CN | 101135102 | * | 3/2008 |
| DE | 195 08 534 | * | 9/1996 |
| DE | 197 34 081 | * | 2/1999 |
| JP | 2001-252497 | * | 9/2001 |
| JP | 2004-337406 | * | 12/2004 |
| JP | 2005-040314 | * | 2/2005 |
| JP | 2005-329045 | * | 12/2005 |
| KR | 2004021318 | * | 3/2004 |
| KR | 2005052132 | * | 6/2005 |
| KR | 2006013462 | * | 2/2006 |
| KR | 2006119118 | * | 11/2006 |
| WO | WO 2005/031058 | * | 4/2005 |

* cited by examiner

*Primary Examiner* — Frankie L Stinson

(74) *Attorney, Agent, or Firm* — Birch, Stewart, Kolasch & Birch, LLP

(57) ABSTRACT

A laundry treating apparatus is disclosed. The laundry treating apparatus includes an outer case defining an appearance of the laundry treating apparatus, a washing tub arranged in the outer case, to receive laundry, a top lid mounted to a top of the outer case such that the top lid is openable and closeable, and an air flow assembly mounted to the top lid, to define a passage communicating an interior of the outer case and an exterior of the outer case. The air flow assembly includes a filter inserted beneath the top lid such that the filter is installed beneath the top lid. The laundry treating apparatus can prevent moisture from staying in the interior of the laundry treating apparatus for a prolonged period of time, thereby preventing a failure of the laundry treating apparatus, generation of an offensive odor and propagation of bacteria in the interior of the laundry treating apparatus.

10 Claims, 8 Drawing Sheets

LAUNDRY TREATING APPARATUS

This application claims the benefit of Korean Patent Application No. 10-2008-0023571, filed on Mar. 13, 2008, which is hereby incorporated by reference as if fully set forth herein.

BACKGROUND OF THE INVENTION

1. Field of the Invention

The present invention relates to a laundry treating apparatus, and more particularly to a laundry treating apparatus capable of removing moisture form the interior of the laundry treating apparatus after the completion of operation of the laundry treating apparatus, thereby preventing generation of an offensive odor and propagation of bacteria caused by moisture in the interior of the laundry treating apparatus.

2. Discussion of the Related Art

A laundry treating apparatus means a machine used to perform a treatment such as washing, drying, and regeneration. Typically, such a laundry treating apparatus means a washing machine having a function to wash laundry, a drying machine having a function to dry washed laundry, or a washing/drying machine having both the washing and drying functions.

Generally, such a conventional laundry treating apparatus is of a top loading type in which laundry is loaded into the laundry treating apparatus through the top of an outer case. In this case, accordingly, a top lid provided at the top of the outer case is opened when it is desired to load laundry into the laundry treating apparatus. The laundry treating apparatus operates under the condition in which the top lid is closed. In order to unload the laundry after the completion of the operation, the top lid is again opened.

Generally, the above-mentioned conventional laundry treating apparatus is maintained in a sealed state after the unloading of the laundry. For this reason, there is a problem in that the laundry treating apparatus get damp due to water left in the interior thereof after the completion of the operation.

In this case, a circuit board included in a control panel of the laundry treating apparatus may be short-circuited due to moisture. In addition, where the laundry treating apparatus is maintained in the sealed state for a prolonged period of time, there may be a sanitation problem in that an offensive odor may be generated, or mold or bacteria may propagate.

Referring to FIG. 1, an example of the above-mentioned conventional laundry treating apparatus is illustrated. The conventional laundry treating apparatus includes

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus, in which the interior of the laundry treating apparatus can communicate with the exterior of the laundry treating apparatus, to flow air therebetween, thereby being capable of preventing the interior of the laundry treating apparatus from getting damp.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus comprises: an outer case defining an appearance of the laundry treating apparatus; a washing tub arranged in the outer case, to receive laundry; a top lid mounted to a top of the outer case such that the top lid is openable and closeable; and an air flow assembly mounted to the top lid, to define a passage communicating an interior of the outer case and an exterior of the outer case, the air flow assembly comprising a filter inserted beneath the top lid such that the filter is installed beneath the top lid.

The air flow assembly may be arranged at a position deviated to one side of the top lid, to allow ambient air to enter and leave the air flow assembly during rotation of the washing tub.

The air flow assembly may further comprise a ventilating member for allowing ambient air to enter and leave the air flow assembly, a filter unit inserted beneath the ventilating member, and coupled with the ventilating member, and a cover member installed over the ventilating member, to define an appearance of the air flow assembly.

The filter unit may comprise the filter for removing foreign matter from the ambient air introduced into the outer case, and a housing for holding the filter.

The housing may be insert-molded in a state, in which the filter is held in the housing, such that the housing is integrally formed with the filter.

The housing may comprise upper and lower housings separably coupled to each other.

The filter may be interposed between the upper and lower housings.

The filter may be seated on an upper surface of the housing, and may be held in the housing in a state, in which the housing is inserted beneath the ventilating member such that the housing is coupled to the ventilating member.

The housing may comprise at least one clamp provided at an upper surface of the housing, to couple the housing to the ventilating member beneath the ventilating member.

The housing may further comprise at least one protrusion formed at one side of the housing such that the at least one protrusion can be engaged in at least one groove formed at a lower surface of the ventilating member, so that the housing can be coupled to the ventilating member in a fitted manner by the clamp in accordance with a pivotal movement of the housing about the protrusion in a state, in which the protrusion is engaged in the groove.

The housing may comprise a rib upwardly protruded from the housing along a peripheral edge of the housing.

The cover member may be mounted to an upper surface of the top lid, and may comprise an opening, through which air flows.

The cover member may further comprise a shield member for preventing an inside of the opening from being outwardly exposed. The shield member may have an area smaller than the opening.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

The present invention is applied, in an exemplary embodiment thereof, to a washing machine for washing laundry loaded therein. Of course, the present invention is not limited to this application. The present invention is applicable to any laundry treating apparatus as long as the laundry treating apparatus is configured to treat laundry therein, using water supplied from the outside thereof.

Figure 1:
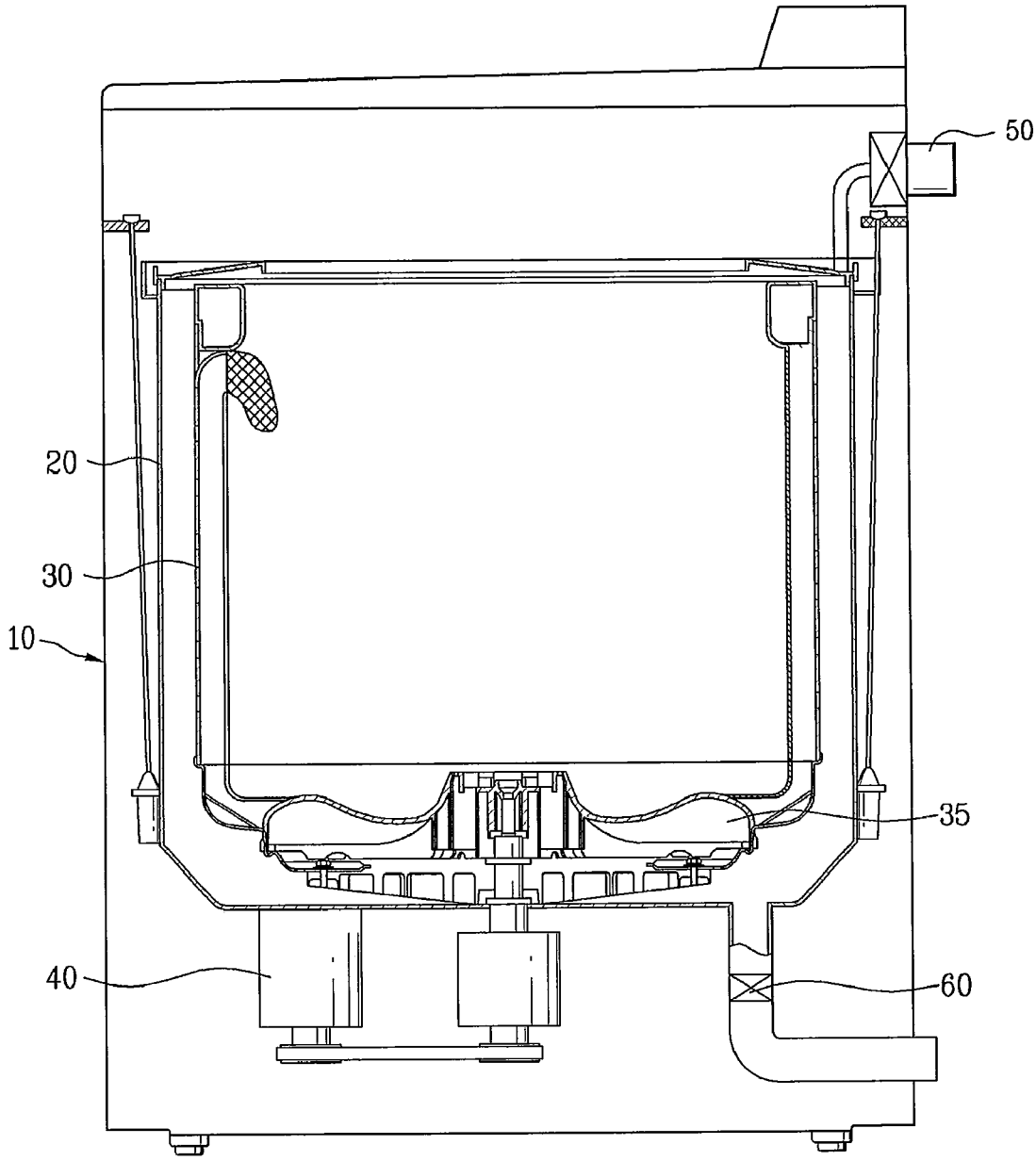
FIG. 1 is a sectional view illustrating an inner configuration of a laundry treating apparatus according to an exemplary embodiment of the present invention.
Figure 2:
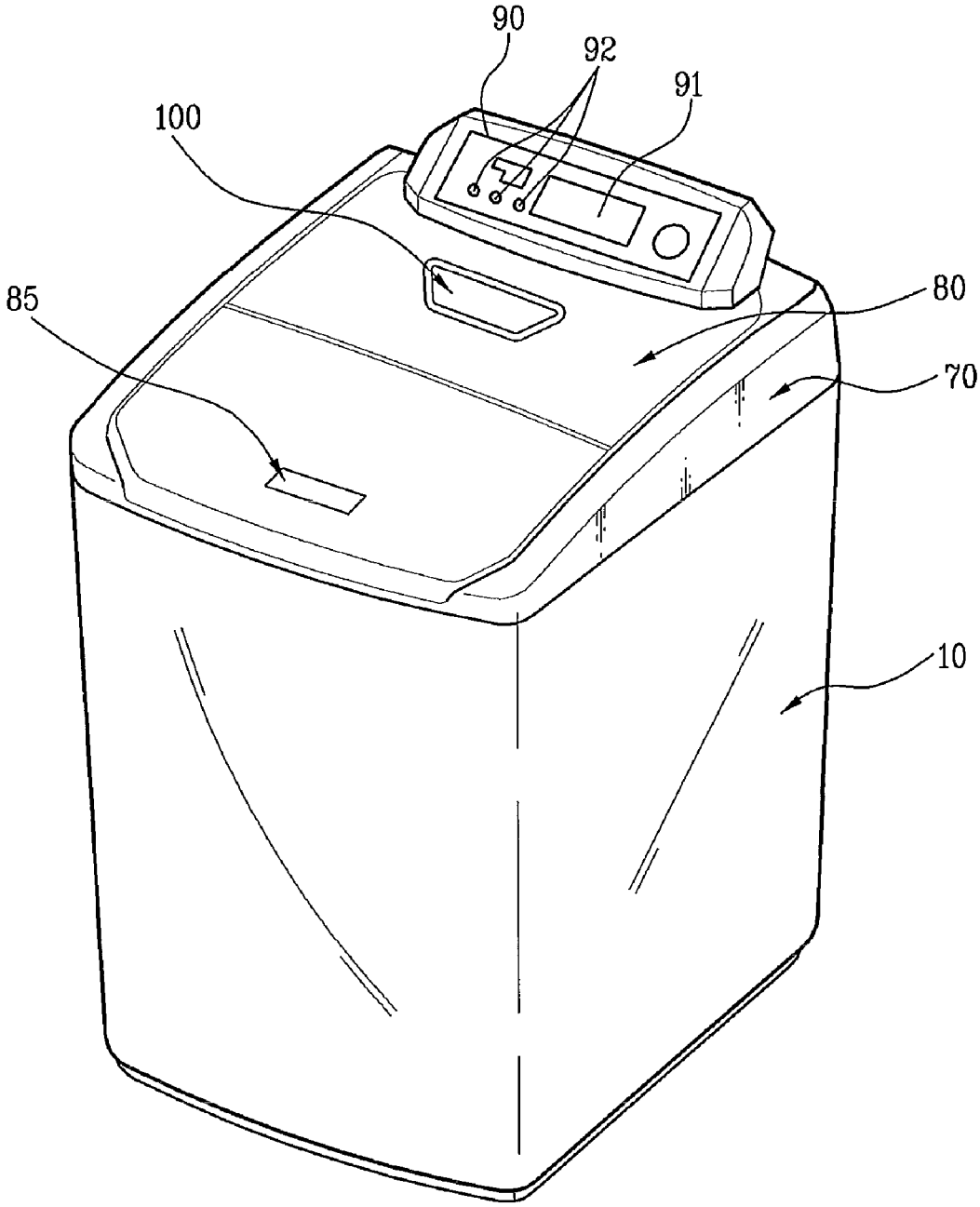
FIG. 2 is a perspective view illustrating an appearance of the laundry treating apparatus according to the illustrated embodiment of the present invention.

FIG. 1 is a sectional view illustrating an inner configuration of a laundry treating apparatus according to an exemplary embodiment of the present invention. FIG. 2 is a perspective view illustrating an appearance of the laundry treating apparatus according to the illustrated embodiment of the present invention.

As shown in FIG. 1, the laundry treating apparatus according to the illustrated embodiment of the present invention includes an outer case 10 defining an appearance of the laundry treating apparatus, a water tub 20 arranged in the outer case 10, to receive wash water, and a washing tub 30 arranged in the water tub 20, to perform washing and spin-drying operations for laundry. The laundry treating apparatus also includes a pulsator 35 mounted to a bottom of the washing tub 30 within the washing tub 30, to generate a flow of water in accordance with rotation thereof, and thus to wash the laundry, and a driving unit 40 connected to the pulsator 35, to rotate the pulsator 35.

A water supply unit 50 is installed at a top of the water tub 20, to supply wash water to the water tub 20. At a bottom of the water tub 20, a draining unit 60 is installed to externally drain wash water. The laundry treating apparatus further includes a top lid 80 mounted to a top of the outer case 10 such that it can be opened and closed.

In addition to the washing tub 30, various devices for performing operations for treatment of laundry are installed in the outer case 10. The outer case 10 defines the appearance of the laundry treating apparatus while protecting the devices installed therein.

A top cover 70 is mounted to the top of the outer case 10. A control panel 90 for controlling the laundry treating apparatus is mounted to an upper surface of the top cover 70, in addition to the top lid 80.

The control panel 90 may include various operating elements 92 for allowing the user to control operation of the laundry treating apparatus. A separate display 91 may also be provided at the control panel 90, to display contents of operation of the laundry treating apparatus.

The top lid 80 may be mounted to the top cover 70 by a connecting member such as a hinge such that it can be opened and closed. Accordingly, the user can load laundry into the washing tub 30 or unload washed laundry from the washing tub 30 after opening the top lid 80.

As shown in FIG. 2, in accordance with the illustrated embodiment, the top lid 80 is pivotally connected to a rear portion of the top cover 70 by a hinge. The top lid 80 is mounted such that it is upwardly pivoted about the hinge from a front side, to open and close the laundry treating apparatus.

In order to allow the user to easily open and close the top lid 80, a grip 85 may be formed at a front portion of the top lid 80. More preferably, the top lid 80 may be folded at a central portion thereof, in order to allow the user to open and close the top lid 80 by lifting the top lid 80 along a track having a small radius.

Meanwhile, the laundry treating apparatus may further include an air flow assembly 100 for forming a passage communicating the interior of the outer case 10 and the exterior of the outer case 10. The air flow assembly 100 may be installed at the top of the top lid 80.

In a general laundry treating apparatus, which treats laundry, using wash water supplied from the outside of the laundry treating apparatus, a certain amount of water may be left on an inner wall of a water tub containing the wash water and in a draining passage, even after the wash water is drained upon completion of operation of the laundry treating apparatus.

For this reason, if the interior of the laundry treating apparatus is completely sealed from the exterior of the laundry treating apparatus, it may be maintained in a high humid state due to the left water. In this case, a circuit board included in a control panel of the laundry treating apparatus may be short-circuited due to moisture. In addition, where the laundry treating apparatus is maintained in the sealed state for a prolonged period of time, there may be a sanitation problem in that an offensive odor may be generated, or mold or bacteria may propagate.

Therefore, it is desirable to communicate the interior of the laundry treating apparatus and the exterior of the laundry treating apparatus, using the air flow assembly 100, as in the illustrated embodiment.

In this case, the laundry treating apparatus is provided with a passage allowing ambient air to enter and leave the interior of the laundry treating apparatus. Accordingly, there is an advantage in that moisture present in the interior of the laundry treating apparatus can be naturally discharged to the exterior of the laundry treating apparatus.

The introduction of ambient air through the air flow assembly 100 may be promoted by a differential pressure generated during rotation of the washing tub 30.

When a spin-drying operation is carried out as a final process in a washing cycle, ambient air is positively introduced into the washing tub 30 in accordance with a high-speed rotation of the washing tub 30, and then outwardly ejected from the washing tub 30. Thus, the ambient air performs a function to take off wash water left on the inner wall of the water tub 30. As a result, the amount of water left on the water tub 30 after the completion of operation of the laundry treating apparatus is considerably reduced.

Where a laundry drying operation is performed after the completion of the washing operation in the laundry treating apparatus, under the condition in which the washing tub 30 rotates, humid air produced during the laundry drying operation can be exchanged with ambient dry air in accordance with the rotation of the washing tub 30. In this case, accordingly, an enhancement in laundry drying efficiency is achieved.

When the deviation of the installation position of the air flow assembly 100 on the top lid 80 from the center of the washing tub 30 increases, the amount of ambient air introduced into the washing tub 30 during rotation of the washing tub 30 increases. Accordingly, it is desirable to form the air flow assembly at a position deviated to one side of the top lid 80.

Figure 3:
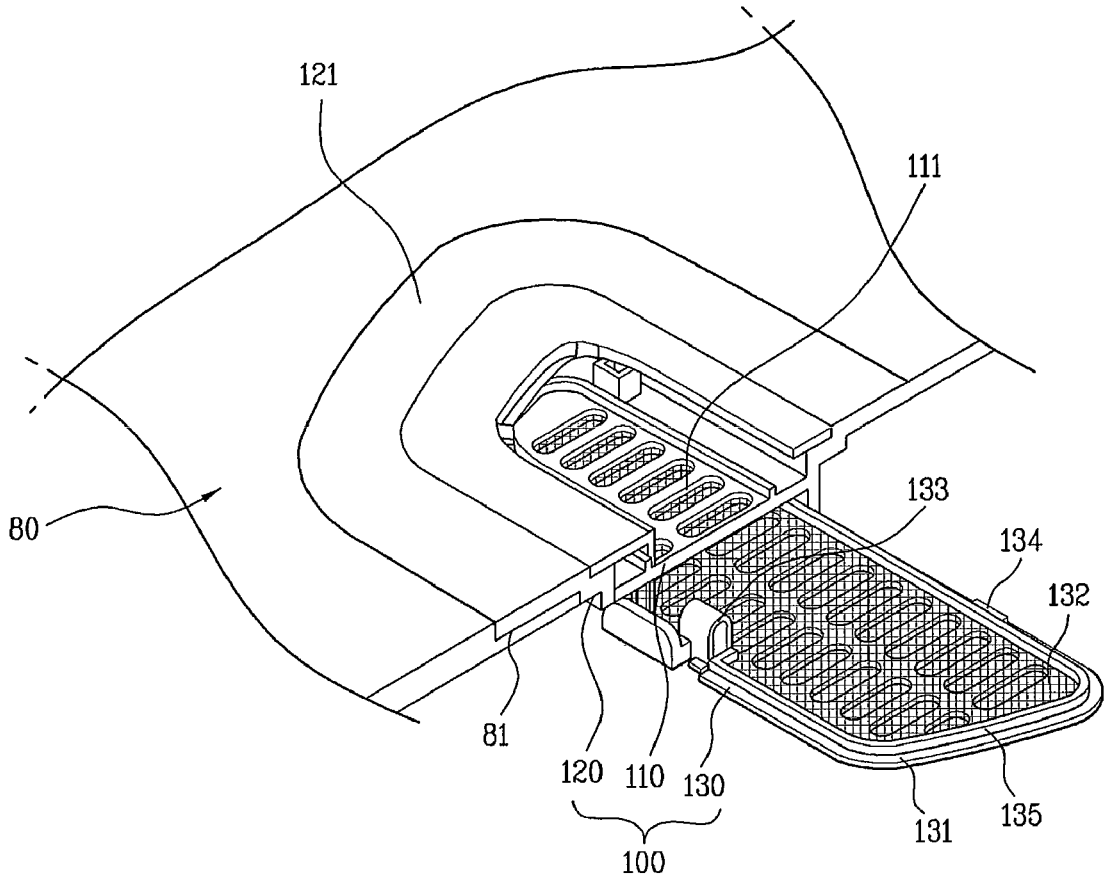
FIG. 3 is a sectional view illustrating an air flow assembly according to the illustrated embodiment of the present invention.
Figure 4:
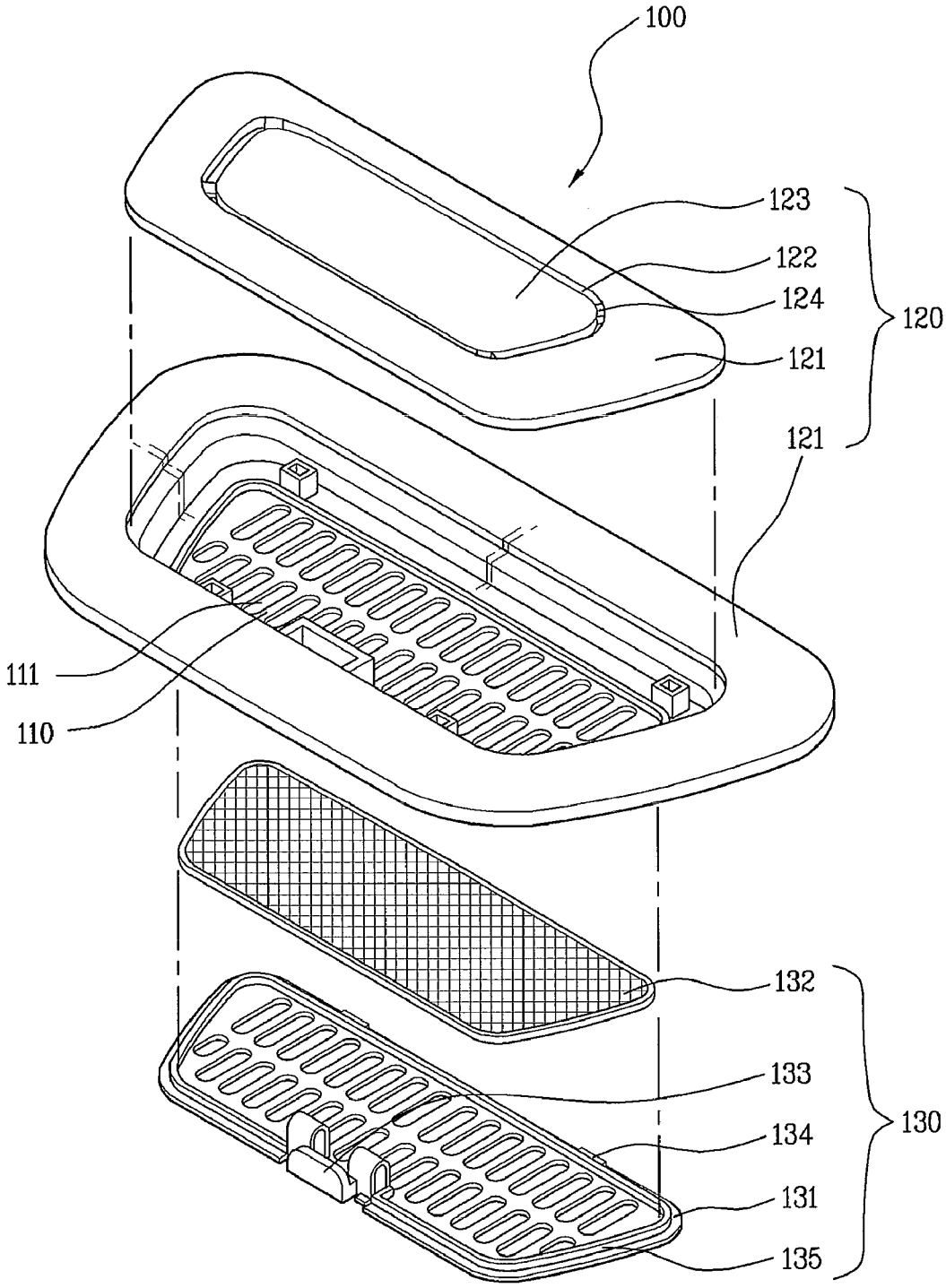
FIG. 4 is an exploded perspective view illustrating the air flow assembly.

FIG. 3 is a sectional view illustrating the air flow assembly 100. FIG. 4 is an exploded perspective view illustrating the air flow assembly 100. Hereinafter, the air flow assembly 100 will be described in detail with reference to FIGS. 3 and 4.

As shown in FIG. 4, the air flow assembly 100 includes a ventilating member 110 for allowing ambient air to enter and leave the air flow assembly 100, a filter unit 130 inserted beneath the ventilating member 110 such that the filter unit 130 is coupled with the ventilating member 110, and a cover member 120 installed over the ventilating member 110, to define an appearance of the air flow assembly 100.

The ventilating member 110 may include a plurality of ventilating holes 111 to allow air present in the interior of the outer case 10 to be exchanged with ambient air.

The ventilating member 110 is preferably mounted at a position downwardly stepped from an upper surface of the top lid 80, in order to prevent the ventilating member 110 from being outwardly exposed. In this case, the ventilating member 110 may be directly installed on the top lid 80. Alternatively, the ventilating member 110 may be integrally formed with the cover member 120 while being mounted at a position downwardly stepped from an upper surface of the top lid 80.

Meanwhile, the cover member 120 may be exposed at the upper surface of the top lid 80, to define an appearance of the air flow assembly 100 while protecting the ventilating member 110 and filter unit 130.

An opening 122 is formed through the cover member 120, to allow air to flow through the cover member 120. A decoration member 121 may also be provided at the outside of the cover member 120. The decoration member 121 is coupled with the upper surface of the top lid 80.

As shown in FIG. 4, a seat 81 is provided at the upper surface of the top lid 80 such that it is stepped from the upper surface of the top lid 80 to a certain depth while extending along an upper edge of the ventilating member 110. In this case, the decoration member 121 of the cover member 120 is preferably seated on the seat 81.

Preferably, the depth of the seat 81 stepped from the upper surface of the top lid 80 corresponds to the thickness of the decoration member 121. In this case, an enhancement in appearance beauty is achieved because the decoration member 121 is flush with the upper surface of the top lid 80 while being protruded from the upper surface of the top lid 80.

Meanwhile, it is preferred that the cover member 120 be formed to prevent the inside of the opening 122 from being outwardly exposed. This is because the ventilating member 110 and filter unit 130 arranged inside the opening 122 do not have a beautiful appearance, and there may be a possibility that foreign matter may be introduced into the opening 122, thereby interfering with a flow of air.

In the illustrated embodiment, accordingly, it is preferable for the cover member 120 to further include a separate shield member 123 to shield the opening 122.

The shield member 123 may have an area smaller than the opening 122. Preferably, the shield member 123 is mounted to the decoration member 121 over the ventilating holes 111 by fitting ribs 124 extending from an inner edge of the decoration member 121 defining the opening 122.

Since the shield member 123 has a smaller area than the opening 122, a gap is defined between the shield member 123 and the opening 122, thereby providing a passage allowing ambient air to flow therethrough.

Of course, this structure is intended only for illustrative purposes. Alternatively, the shield member 123 may be formed to have a larger size than the opening 122. In this case, the mounting of the shield member 123 may be achieved by fitting ribs extending upwardly from the decoration member 121.

In another embodiment, a door (not shown) may be provided to selectively open and close the opening 122, in place of the shield member 123 provided to shield the opening 122 of the cover member 120.

In this case, the door may be pivotably mounted by a hinge, and may have teeth at a portion thereof connected to the hinge, to adjust the opening degree thereof. In this case, there is an advantage in that the inclination of the door can be adjusted, thereby adjusting the amount of ambient air introduced through the air flow assembly 100.

Thus, the cover 120 may have various structures without being limited to the illustrated embodiment, as long as it is configured to define an appearance of the air flow assembly 110 while providing a passage allowing ambient air to flow therethrough.

Meanwhile, the filter unit 130 functions to filter air passing through the air flow assembly 100, to remove foreign matter from the air.

In the illustrated embodiment, the filter unit 130 includes a filter 132 for removing foreign matter from air, and a housing 131 for holding the filter 132.

Figure 5A:
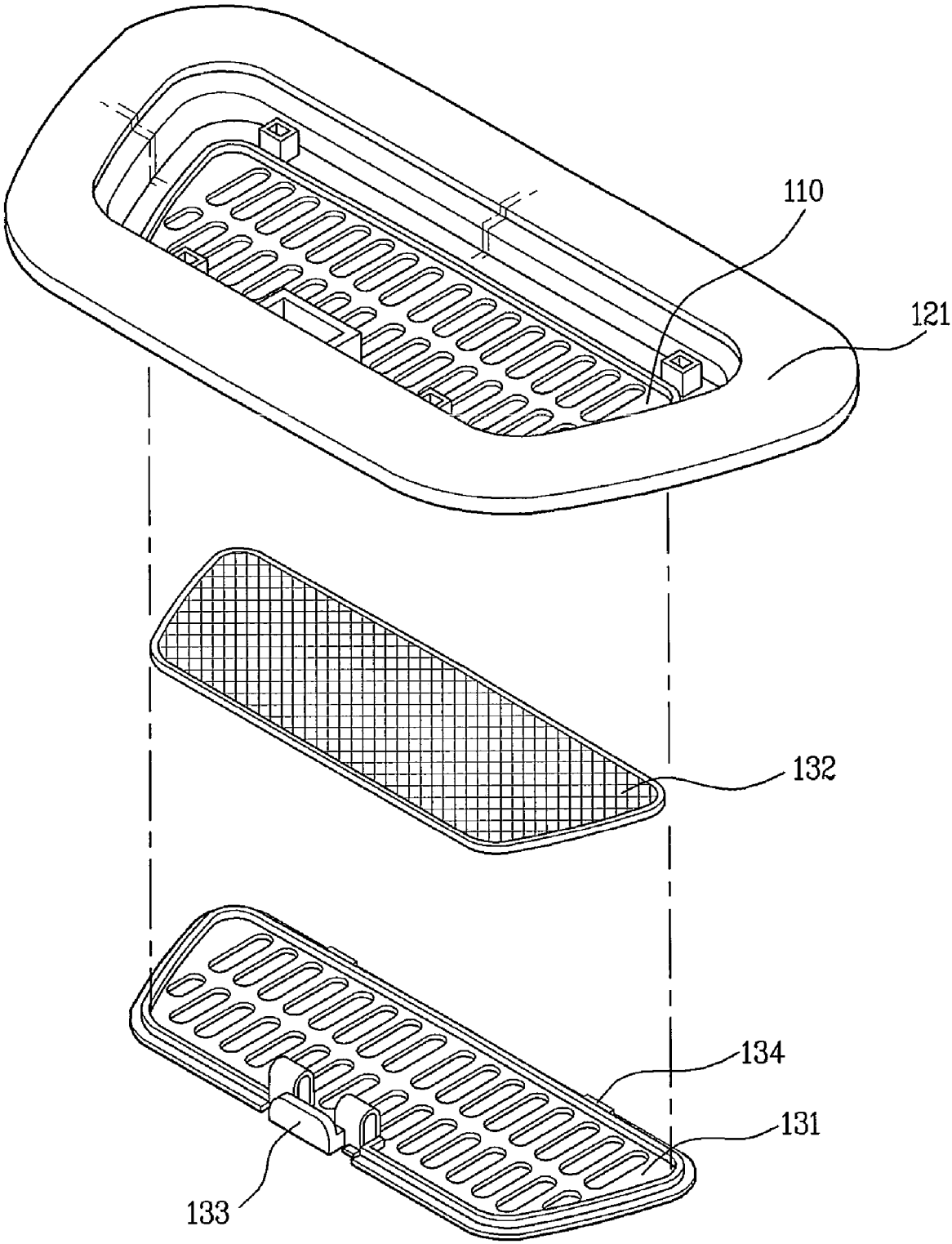
FIGS. 5A and 5B are schematic views illustrating a coupling method for a filter unit shown in FIG. 3.
Figure 5B:
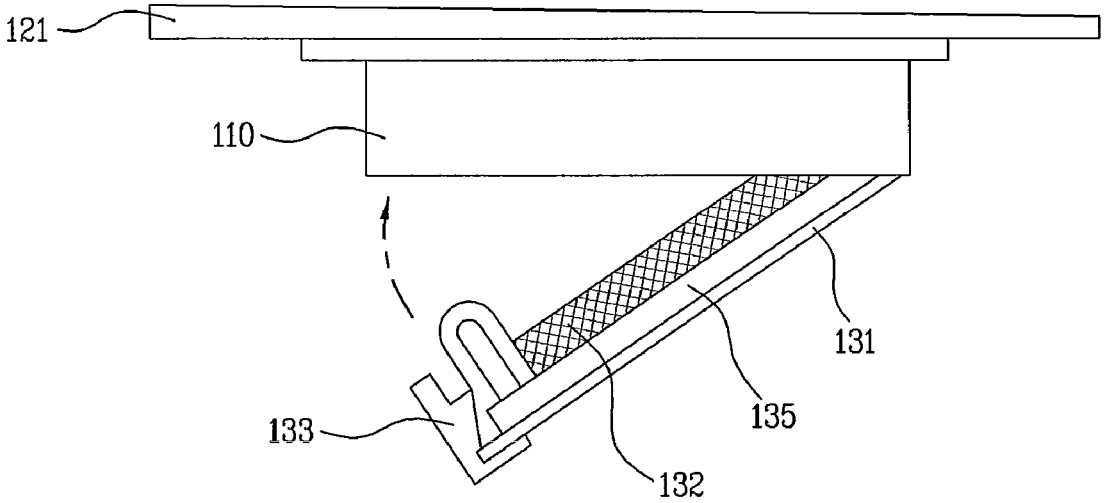

As shown in FIGS. 5A and 5B, the filter unit 130 according to the illustrated embodiment is preferably installed beneath the ventilating holes 111. In this case, it is possible to install the filter unit 130 beneath the ventilating holes 111 after upwardly opening the top lid 80.

To this end, it is preferred that the housing 131 be formed to have an opening capable of sufficiently opening the ventilating holes 111 of the ventilating member 110, to prevent the air flowing passage from being restricted. In the illustrated embodiment, accordingly, the housing 131 has, at the inside thereof, a shape corresponding to a shape formed by the ventilating holes 111 of the ventilating member 110.

Preferably, the filter unit 130 is installed such that it can be downwardly separated beneath the top lid 80. When foreign matter is excessively accumulated on the filter unit 130 due to the use of the filter unit 130 for a prolonged period of time, the flow of air through the air flow assembly 100 may be restricted. In this connection, it is possible to easily replace the filter unit 130 by a new one, and to easily clean the filter unit 130 because the filter unit 130 is separably installed in accordance with the illustrated embodiment.

Thus, in the illustrated embodiment, it is preferred that the installation of the housing 131 of the filter unit 130 be achieved by inserting the housing 131 into a region defined beneath the ventilating member 110.

In detail, as shown in FIG. 5A, the housing 131 may include protrusions 134 extending outwardly from one edge of the housing 131, and a clamp 133 formed at an opposite edge of the housing 131 such that it is coupled with the ventilating member 110. The ventilating member 110 may be provided with grooves (not shown) corresponding to the protrusions 134, at an extension extending downwardly from an edge of the ventilating member 110. The ventilating member 110 may also be provided, at a portion thereof opposite to the grooves, with a recess, in which the clamp 133 will be fitted.

Thus, it is possible to mount the housing 131 to the ventilating member 110 by engaging the protrusions 134 of the housing 131 in the grooves of the ventilating member 110, and then upwardly pivoting the housing 131 about the protrusions 134 until the clamp 133 is fitted in the recess of the ventilating member 110.

Since the filter unit 130 is prevented from being outwardly exposed as it is mounted beneath the top lid 80, in the illustrated embodiment, it is possible to achieve an improvement in appearance beauty. Also, there is an advantage in that easy cleaning and replacement of the filter unit 130 can be achieved because the filter unit 130 is separably mounted.

Of course, in another embodiment, the filter unit 130 may be configured to be directly coupled to the lower surface of the top lid, in place of the ventilating member 110. It will also be appreciated that various separable coupling methods other than the coupling method according to the illustrated embodiment may be used.

Meanwhile, as shown in FIG. 5A, a foam filter may be used for the filter 132 of the filter unit 130.

The foam filter has a sponge shape having a certain thickness. Accordingly, there is an advantage in that it is possible to effectively filter off foreign matter from air, as compared to a net filter having a planar shape.

The filter 132, which is a foam filter, can be held between the housing 131 and the ventilating member 110 as the housing 131 is coupled to the ventilating member 110 under the condition in which the filter 132 is seated on the housing 131. In this case, it is possible to separate only the filter 132 of the filter unit 130, for cleaning and replacement thereof.

Meanwhile, the housing 131 of the filter unit 130 is preferably provided with a spacing rib 135 upwardly protruded from the housing 131 along a peripheral edge of the housing 131.

If the housing 131 comes into contact with the ventilating member 110 in a state, in which the housing 131 is coupled to the ventilating member 110 beneath the ventilating member 110, the passage of ambient air may be restricted as the filter 132, namely, the foam filter, is pressed. In the illustrated embodiment, accordingly, the spacing rib 135 is provided at the housing 131, to secure a sufficient passage in the coupled state of the filter unit 130 and ventilating member 110.

Although the filter unit 130 uses the foam filter in the illustrated embodiment, as described above, it is intended only for illustrative purposes. Filter units different from the above-described filter unit 130 may also be used.

Figure 6A:
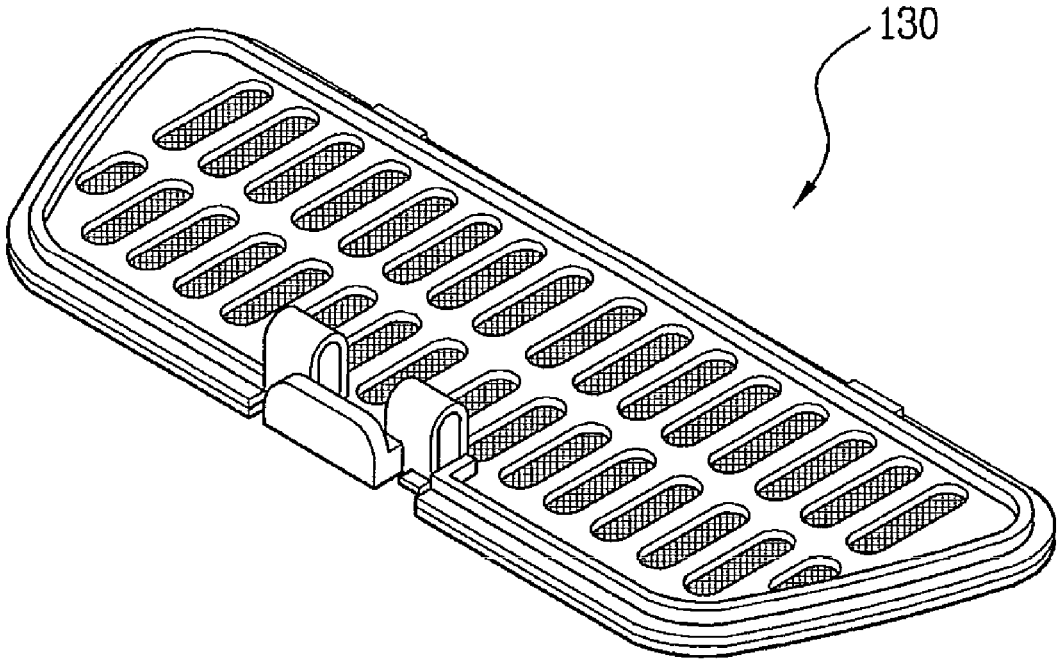
FIGS. 6A and 6B are perspective views illustrating a configuration of a filter unit according to another embodiment of the present invention.

For example, the filter unit 130 may be configured such that the filter is integrally formed with the housing 131, which has a structure of FIG. 6A, using an insert molding process.

Figure 6B:
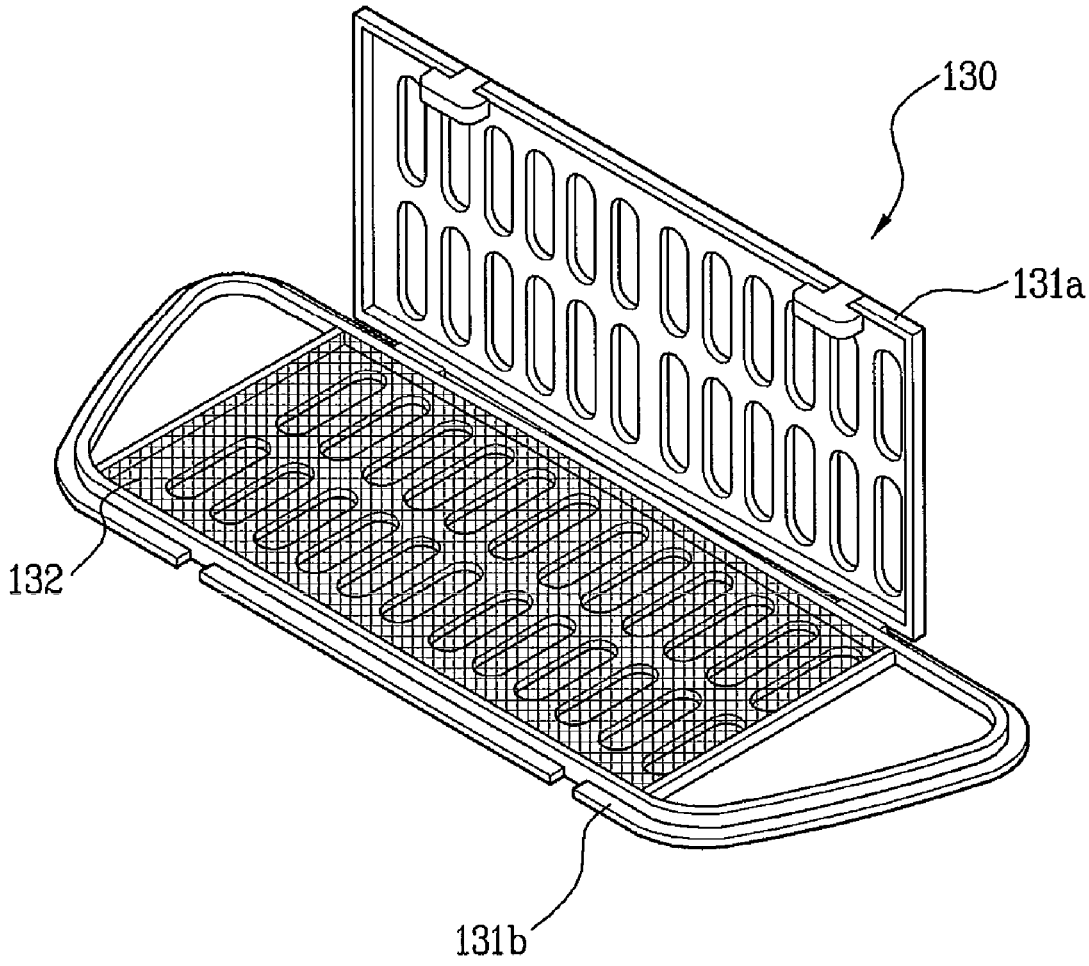

In another example, the housing 131 may be configured to be divided into an upper housing 131*a* and a lower housing 131*b*, as shown in FIG. 6B. In this case, the filter 132 may be interposed between the upper and lower housings 131*a* and 131*b*.

Thus, the filter unit of the present invention is not limited to the illustrated embodiments, and the technical idea of the present invention can be implemented using various filter units other than the above-described filter unit.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The laundry treating apparatus according to the present invention prevents moisture from staying in the interior of the laundry treating apparatus for a prolonged period of time, even in a closed state of the top lid. Accordingly, it is possible to prevent a failure of the laundry treating apparatus, generation of an offensive odor and propagation of bacteria in the interior of the laundry treating apparatus.

In addition, since the filter is installed in a region where air flows, it is possible to prevent external foreign matter from being introduced into the laundry treating apparatus. Also, there is an advantage in that easy cleaning and replacement of the filter can be achieved because the filter is separably installed.

What is claimed is:

1. A laundry treating apparatus comprising:

an outer case defining an appearance of the laundry treating apparatus;

a washing tub arranged in the outer case, to receive laundry;

a top lid mounted to a top of the outer case such that the top lid is openable and closeable; and an air flow assembly mounted to the top lid to define a passage communicating an interior of the outer case and an exterior of the outer case, the air flow assembly comprising a ventilating member mounted to an upper surface of the top lid for allowing ambient air to enter or leave the air flow assembly, a filter unit inserted beneath the ventilating member and coupled with the ventilating member, and a cover member installed over the ventilating member to define an appearance of the air flow assembly, wherein the cover member comprises an opening to communicate with the ventilating member, a shield member for preventing an inside of the opening from being outwardly exposed and a fitting rib extended from an inner edge of the opening to fix the shield member, and the shield member has an area smaller than the opening to provide a gap between the shield member and the opening.

2. The laundry treating apparatus according to claim 1, wherein the air flow assembly is arranged at a position deviated to one side of the top lid, to allow ambient air to enter and leave the air flow assembly during rotation of the washing tub.

3. The laundry treating apparatus according to claim 1, wherein the filter unit comprises the filter for removing foreign matter from the ambient air introduced into the outer case, and a housing for holding the filter.

4. The laundry treating apparatus according to claim 3, wherein the housing is insert-molded in a state, in which the filter is held in the housing, such that the housing is integrally formed with the filter.

5. The laundry treating apparatus according to claim 3, wherein the housing comprises upper and lower housings separably coupled to each other.

6. The laundry treating apparatus according to claim 5, wherein the filter is interposed between the upper and lower housings.

7. The laundry treating apparatus according to claim 3, wherein the filter is seated on an upper surface of the housing, and is held in the housing in a state, in which the housing is inserted beneath the ventilating member such that the housing is coupled to the ventilating member.

8. The laundry treating apparatus according to claim 7, wherein the housing comprises at least one clamp provided at an upper surface of the housing, to couple the housing to the ventilating member beneath the ventilating member.

9. The laundry treating apparatus according to claim 8, wherein the housing further comprises at least one protrusion formed at one side of the housing such that the at least one protrusion can be engaged in at least one groove formed at a lower surface of the ventilating member, so that the housing can be coupled to the ventilating member in a fitted manner by the clamp in accordance with a pivotal movement of the housing about the protrusion in a state, in which the protrusion is engaged in the groove.

10. The laundry treating apparatus according to claim 3, wherein the housing comprises a rib upwardly protruded from the housing along a peripheral edge of the housing.

* * * * *